US006690988B2

(12) United States Patent
Kaymer et al.

(10) Patent No.: US 6,690,988 B2
(45) Date of Patent: Feb. 10, 2004

(54) PRODUCING AN OBJECT-BASED DESCRIPTION OF AN EMBROIDERY PATTERN FROM A BITMAP

(75) Inventors: Andrew Bennett Kaymer, Essex (GB); Martin Bysh, London (GB)

(73) Assignee: VSM Group AB, Husqvarna (SE)

( * ) Notice: Subject to any disclaimer, the term of this patent is extended or adjusted under 35 U.S.C. 154(b) by 0 days.

(21) Appl. No.: 10/226,369

(22) Filed: Aug. 22, 2002

(65) Prior Publication Data

US 2003/0074100 A1 Apr. 17, 2003

(30) Foreign Application Priority Data

Aug. 22, 2001 (GB) ..... 0120472

(51) Int. Cl.[7] ..... G06F 19/00; D05C 5/02
(52) U.S. Cl. ..... 700/138; 112/102.5
(58) Field of Search ..... 700/138, 136, 700/137; 112/475.19, 470.06, 102.5

(56) References Cited

U.S. PATENT DOCUMENTS 4,991,524 A 2/1991 Ozaki ..... 112/121.12
5,563,795 A 10/1996 Futamura et al. ..... 364/470.09
5,880,963 A * 3/1999 Futamura ..... 700/138
5,957,068 A * 9/1999 Mizuno ..... 700/138 X
6,192,292 B1 2/2001 Taguchi ..... 700/138

FOREIGN PATENT DOCUMENTS

GB 2 353 805 3/2001

* cited by examiner

*Primary Examiner*—Peter Nerbun
(74) *Attorney, Agent, or Firm*—Theodore M. Magee; Westman, Champlin & Kelly, P.A.

(57) ABSTRACT

There is disclosed a method of converting a bitmap to an object-based embroidery pattern by generating a skeleton from the bitmap and traversing paths and nodes identified in the skeleton, the embroidery pattern objects being generated during the traversal. The outline of the bitmap is used to define parts of the boundaries of the generated objects, which are laid down using a linear stitch type on the first traversal of a skeleton path and a fill stitch type on the second traversal of the skeleton path.

22 Claims, 10 Drawing Sheets

IMAGE FILE
102
IDENTITY SUBJECT BITMAP
104
SUBJECT BITMAP
106
CLEAN, THIN, SIMPLIFY
110
OUTLINE, SIMPLIFY
108
SKELETON
112
FIND AND TIDY NODES/PATHS
114
OUTLINE BITMAP
110
NODES
116
PATHS
118
IDENTIFY OBJECT CONTROL POINTS
120
TRAVERSE PATHS/ NODES GENERATING CAN OBJECTS
124
OBJECT CONTROL POINTS
122
CAN OBJECTS
126

PRODUCING AN OBJECT-BASED DESCRIPTION OF AN EMBROIDERY PATTERN FROM A BITMAP

BACKGROUND OF THE INVENTION

The present invention is concerned with methods of producing object-based design descriptions for embroidery patterns from bitmaps or similar image formats.

Embroidery designs, when created using computer software, are typically defined by many small geometric or enclosed curvilinear areas. Each geometric area may be defined by a single embroidery data object comprising information such as the object outline, stitch type, color and so on.

For example, a rectangular area of satin stitches might be defined in an embroidery object by the four control points that make up its four corners, and a circle area of fill stitches might be defined by two control points, the center of the circle and a point indicating the radius. A more complex shape would normally be defined by many control points, spaced at intervals along the boundary of the shape. These control points may subsequently be used to generate a continuous spline approximating the original shape.

Having generated an object-based design description, conversion software is used to convert the embroidery objects into a vector-based stitch design which is then used to control an embroidery machine. Such stitch designs contain a sequence of individual stitch instructions to control the embroidery machine to move an embroidery needle in a specified manner prior to performing the next needle insertion. Apart from such vector data, stitch instructions may also include data instructing the embroidery machine to form a thread color change, a jump stitch or a trim.

The derivation of discrete geometric areas for creating embroidery objects from a bitmap or other image format is conventionally carried out by the user of a suitably programmed computer by entering a large number of control points, typically through superposition on a display of the image. However, manual selection of control points is a time consuming and error prone process. It would therefore be desirable to automate the derivation of control points and the construction of the object-based design description from a bitmap or similar image format.

WO99/53128 discloses a method for converting an image into embroidery by determining grain structures in the image using fourier transforms and stitching appropriate unidirectional or bi-directional grain structures accordingly. The document also proposes determining a "thinness" parameter for different regions within an image, and selecting an appropriate stitch type for each region based on this parameter. However, the document does not address the problem of how to automatically process particular regions of an image to generate embroidery objects suitable for stitching.

SUMMARY OF THE INVENTION

The present invention provides a method of operating a computer to produce an object-based description of an embroidery pattern subject, from a subject bitmap describing the subject, the method comprising the steps of:

analyzing the subject bitmap to identify a skeleton of the subject;

analyzing the skeleton to identify a plurality of nodes interlinked by a plurality of paths;

traversing the skeleton by following the paths and nodes; and during the traversal, generating a series of objects describing the subject for the object-based description.

The embroidery pattern subject may typically be a graphical element taken from a digital image, or a simple graphical element such as an alphanumeric character or other symbol. The invention provides a method of producing an object-based description of the subject from which a stitch-based description can be generated, which in turn can be used to control an embroidery machine to stitch out the subject in an attractive and efficient manner.

For the purposes of carrying out the invention, the subject is provided as a subject bitmap. The active, or colored pixels of the bitmap which represent the subject should preferably be continuous in the sense that all active pixels are interconnected. A complex or broken subject can, of course, be represented as a number of different subject bitmaps which can be processed independently.

Usually, the subject bitmap and object-based descriptions will be stored as computer data files. Intermediate data such as the skeleton, the nodes and the paths may be stored as data files or only as temporary data structures in volatile memory.

Preferably the step of traversal includes the steps of: starting at a selected node; and moving between nodes by following the paths interlinking the nodes in such a manner that each path is traversed a first time and a second time. In particular, by traversing each path only twice an efficient stitching out process and attractive end product can be obtained.

Preferably, the step of generating includes the steps of: when a path is traversed for the first time, generating for the path an object having a first stitch type; and when a path is traversed for the second time, generating for the path an object having a second stitch type.

In one embodiment, where the subject is to be stitched out in a linear stitch type such as a running stitch or variant thereof such as a double or quadruple stitch, both the first and second stitch types are linear stitch types.

In,another embodiment, where the subject is to be stitched out using an area-filling stitch, the first stitch type is preferably a linear stitch type which is subsequently overstitched by the area-filling stitch type. The area-filling stitch type most likely to be used in embodiments of the invention is satin stitch, but others such as fill stitch may also be used.

If an area filling stitch is to be used, then preferably the method further comprises the steps of: analyzing the subject bitmap to identify an outline of the subject, and using the outline to define at least a part of the boundary of at least some of the generated objects of the area filling stitch type.

Preferably, the step of analyzing the subject bitmap to identify a skeleton of the subject comprises the step of applying a thinning algorithm to a copy of the subject bitmap to generate the skeleton. Advantageously, a Xhang-Suen type stripping algorithm may be used for this purpose.

Preferably, a preliminary step of expanding the subject bitmap is carried out to ensure that the derived skeleton paths can pass along narrow channels of the subject without interference with or from the derived outline. The expansion is preferably by means of an interpolation routine, to retain the curvature of the original subject. An expansion factor of three or more may be used, but a factor of five is preferred.

The invention also provides computer apparatus programmed to produce an object-based description of an embroidery pattern subject, from a subject bitmap describing the subject, by processing the subject bitmap according to the method of any preceding claim.

Computer program instructions for carrying out the method may be stored on a computer readable medium such as a floppy disk or CD ROM, as may be a file containing an object-based description produced using the method, or a file containing a vector-based stitch description created from such an object-based description.

BRIEF DESCRIPTION OF THE DRAWINGS

Embodiments of the invention will now be described, by way of example only, with reference to the accompanying drawings, of which.

DETAILED DESCRIPTION OF ILLUSTRATIVE EMBODIMENTS

The purpose of the process which will now be described is to generate a series of embroidery objects representative of geometric shapes that together correspond to the shape of an embroidery subject represented as a subject bitmap. Such embroidery objects are often referred to in the art as "CAN" objects. The set of CAN objects corresponding to a subject bitmap enables the generation of a stitch file to stitch out the subject. By generating the CAN objects in a suitable and controlled way, the final stitching of the subject can be achieved in a tidy and efficient manner, with the minimum number of discrete objects, jumps between objects and without unnecessary stitching over of previously stitched objects. If over-stitching is necessary, this should be as even as possible over the whole subject.

Different embroidery subjects may be suitable for reproduction in embroidery using different stitch types. The invention may be applied to any subject bitmap, but is especially suitable for subjects having elongated and generally narrow features for which running and satin stitches are more suitable than fill type stitches.

Figure 1A:
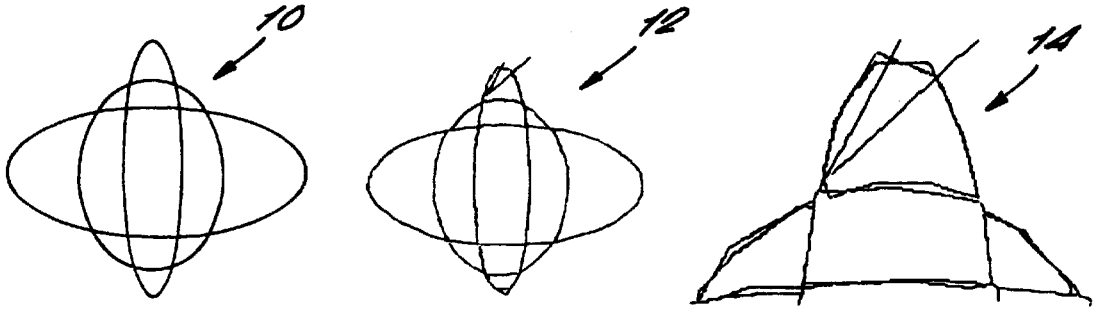
FIG. 1A illustrates an embroidery pattern subject as a graphical object and as stitched using a running stitch.

FIG. 1A shows a subject bitmap 10 suitable for reproduction in embroidery using running stitches. The subject consists of thin lines forming a continuous geometric pattern. An embroidery reproduction of this subject is shown at 12, and an enlargement of a part of the stitch pattern at 14.

Figure 1B:
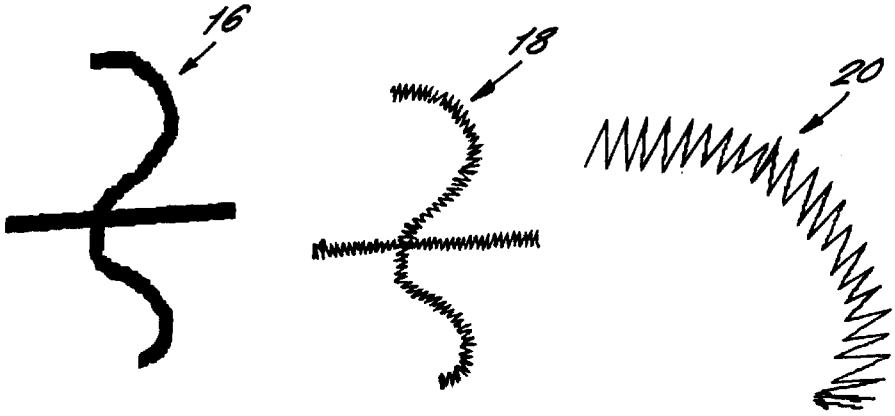
FIG. 1B illustrates an embroidery pattern subject as a graphical object and as stitched using a satin stitch.

FIG. 1B shows a subject bitmap 16 suitable for reproduction in embroidery using satin stitches. The subject consists of broader channels of color than the subject of FIG. 1A, but still forms a continuous geometric pattern. An embroidery reproduction of this subject is shown at 18, and an enlargement of a part of the stitch pattern at 20.

Overview of Process

Figure 2:
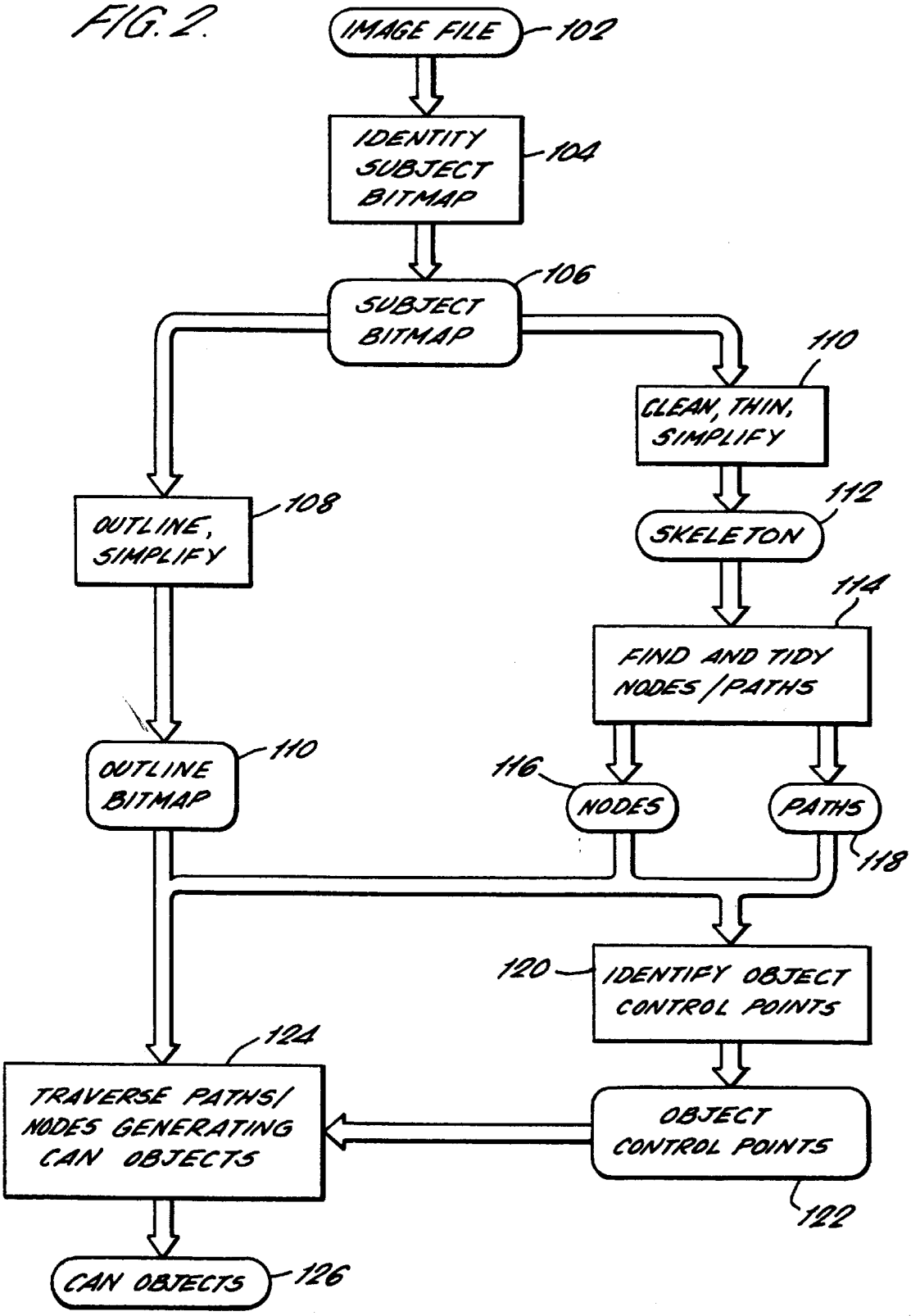
FIG. 2 is a flow diagram illustrating a method according to the invention.

The process for generating CAN objects from a subject bitmap is outlined by means of a flow diagram in FIG. 2. An initial image file 102 is analyzed at step 104 to identify a subject bitmap 106. Two separate processes are then carried using the subject bitmap 106. The first process is the generation and simplification 108 of an outline of the subject to form an outline bitmap 110. The second process begins with the generation, cleaning, thinning and simplification 110 of a skeleton 112 from the subject bitmap 106. The skeleton 112 is then processed at 114 to find and tidy a set of nodes 116 and paths 118 which adequately describe the skeleton.

When the outline 110, nodes 116 and paths 118 have been established, they are used in process 120 to identify appropriate object control points 122. At least some of these control points are points on the outline 110 which define the boundaries between discrete stitching objects which will be used to describe the subject.

In process 124 the CAN objects 126 representative of the subject bitmap 106 are generated by logically traversing the skeleton 112 using the established nodes 116 and paths 118, and generating appropriate CAN objects from the node, path, outline and object control point data in the order of traversal. Importantly for the efficiency and attractiveness of the final embroidery product, the entire skeleton is traversed in such a manner that the embroidery needle will not have to leave the outline 110, and such that no path 118 is traversed more than twice.

Isolation of Subject

The subject bitmap 106 may be generated in a number of different ways. If the starting point is a bitmap or similar image file 102 derived from a photographic or similar source then appropriate thresholding, filtering and other processes may be applied to form suitably discrete areas each of a single color. Any such discrete area of color may be isolated and separated as an individual subject bitmap either automatically or on the command of the user of a suitably programmed computer. Computer graphics images, drawings and similar image files 102 may already by largely composed of suitably discrete areas of single colors, and may require very little pre-processing before bitmap subjects are isolated.

In order to establish the full extent of the area of a subject in an image file 102 a square or diagonal direction fill routine which identifies pixels of a particular color or range of colors may be used. A particular subject area may be chosen by the user of a suitably programmed computer by indicating a single point within the subject area, or by selecting a rough outline, for example by using a pointing device such as a computer mouse.

Having established the extent of the selected subject in the image file 102, the subject bitmap 106 is generated by copying the pixels of the selected subject to a rectangular bilevel bitmap, a pixel being set to active for each corresponding pixel in the selected area of the image, the remaining pixels being set to inactive.

In order to ensure that the paths 118 have enough space to pass through narrow channels of the outline 110, the subject bitmap 106 is expanded in size by a factor of five, although any factor of three or more could be used. This is done using an interpolative scaling routine which retains the curvature of the subject, rather than using a simple pixel scaler which would give the scaled subject a blocked appearance. Thus, a channel of the subject which, in the unscaled subject bitmap is only one pixel in breadth is expanded to a channel which is five pixels in breadth so that the subsequently derived skeleton is clear of the subsequently derived outline.

Generating the Outline

Figure 3:
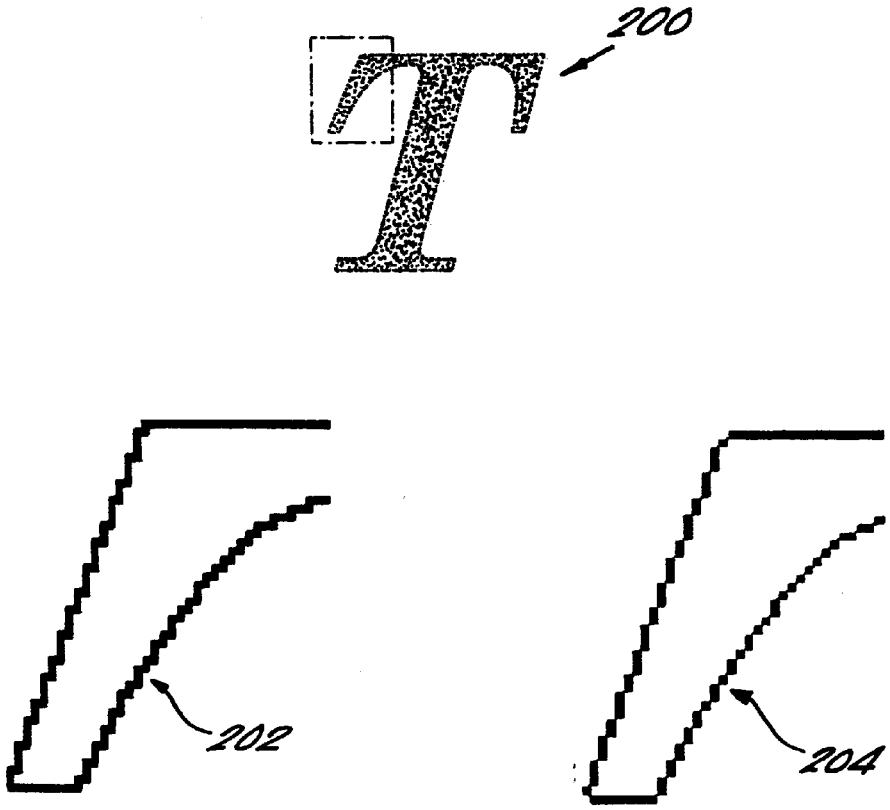
FIG. 3 illustrates the removal of stepping redundancies from an outline generated from a subject bitmap.

The outlining process 108 is illustrated in FIG. 3. The subject comprising active pixels in the subject bitmap is illustrated at 200, a part of an outline bitmap generated from the subject bitmap and including stepping redundancy pixels is illustrated at 202, and the outline bitmap with the stepping redundancies removed is illustrated at 204.

An initially blank outline bitmap 110 of the same size as the subject bitmap 106 is generated. For every active pixel in the subject bitmap 106 which touches an inactive pixel lying directly above, below, left or right of the active pixel, the corresponding pixel in the outline bitmap 110 is set to active. This has the effect of copying only the active pixels which lie around the edge of the subject to the outline bitmap. However, this outline is not always one pixel thick, and requires simplifying by removing the so called stepping redundancy pixels. This is carried out by scanning for redundant active pixels and setting them to-inactive.

Generating the Skeleton

Figure 4:
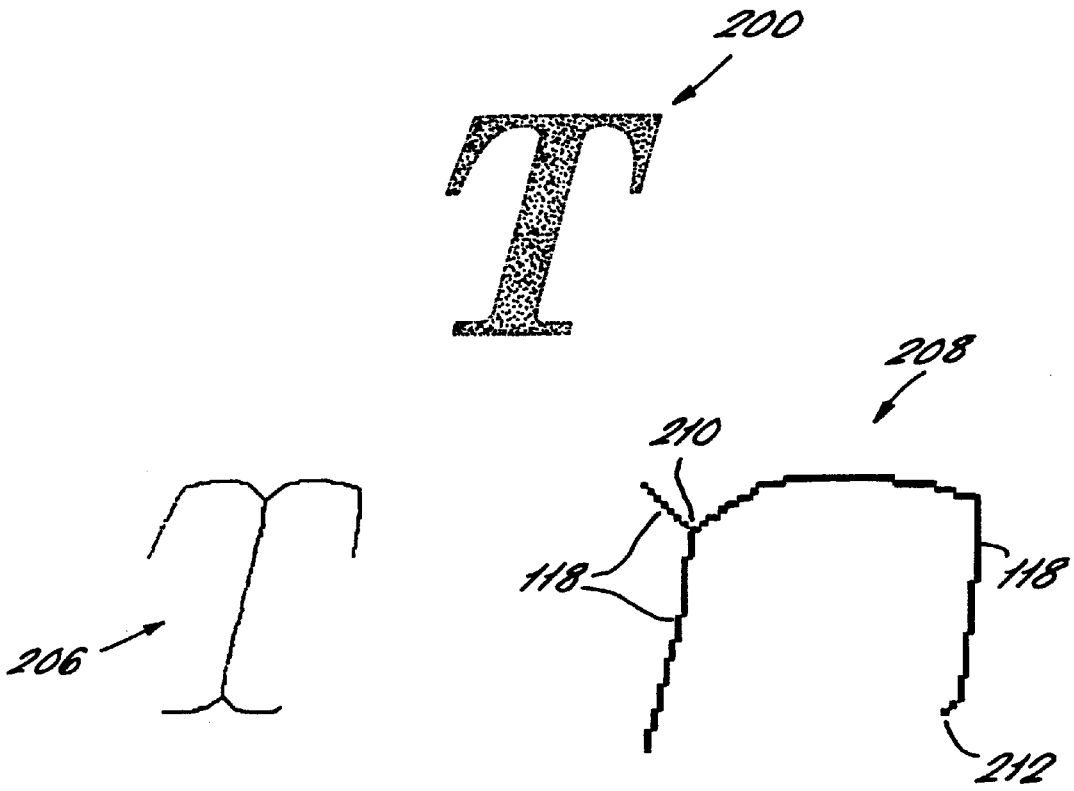
FIG. 4 illustrates the skeletonization of a subject bitmap.

The process 110 of generating a skeleton is illustrated in FIG. 4. The subject as represented by active pixels in the subject bitmap is illustrated at 200. A skeleton of the subject is illustrated at 206 and a portion of the skeleton showing particular features is illustrated at 208. Particular features shown include three paths 118, a junction node 210 where three or more paths join, and a lonely node 212 at the termination of a path. In the fully processed skeleton the paths 118 are all a single pixel thick and the only clumps of pixels are at the junction nodes 210, where three or more paths 118 join.

An initially blank skeleton bitmap 112 of the same size as the subject bitmap 106 is generated. Active pixels from the subject bitmap are copied into the skeleton bitmap, and uncopied pixels remain inactive.

The skeleton bit map 112 is then cleaned to remove pixels which have a connectivity value of less than two. The connectivity of a pixel is established by cycling around the eight pixels adjacent to the subject pixel, back to the starting pixel, and counting the number of pixel type changes from active to inactive. A connectivity value of less than two and the number of active pixels adjacent to the pixel being less than three identifies a pixel as "fluff", i.e. a pixel of the lowest morphological significance. The significance of such pixels, if they are not removed at this stage, will be magnified by the skeletonization process. This magnification is undesirable because it would render the skeleton unrepresentative of the structure of the subject.

Figure 5:
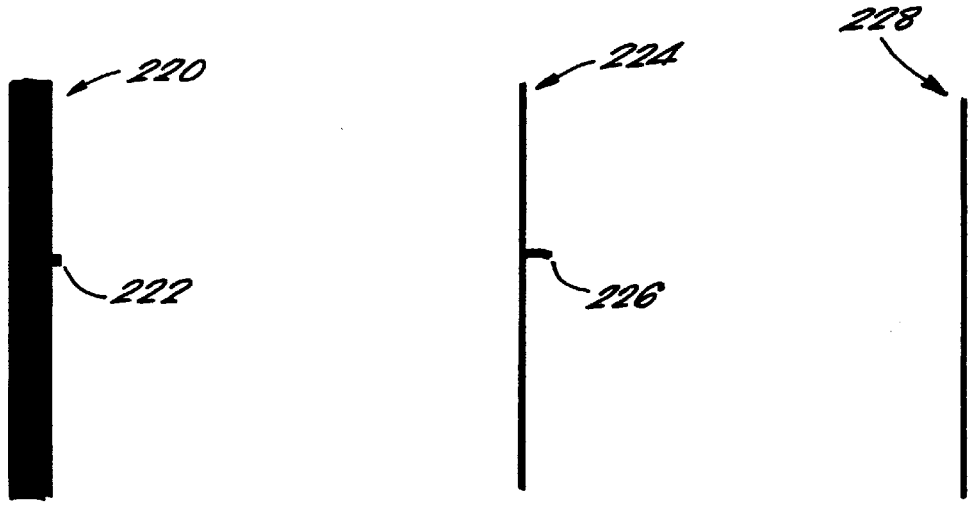
FIG. 5 illustrates the effect on the skeletonization process of removing a fluff pixel from a subject bitmap.

An example of a bitmap subject 220 including a fluff pixel 222 is shown in FIG. 5. The result of carrying out a skeletonization thinning process without first removing the fluff pixel 222 is shown at 224. It can be seen that the fluff pixel 222 has resulted in the creation of a significant extra path 226 which has very little relevance to the original subject 220. The result of carrying out the same skeletonization thinning process having first removed the fluff pixel 222 is shown at 228.

A thinning algorithm is then applied to the cleaned skeleton bitmap. A number of thinning processes are known in the art, but in the present embodiment the Xhang-Suen stripping algorithm is used. This is an iterative algorithm, each iteration comprising first and second steps of identifying and setting to inactive certain active pixels.

In the first step, each active pixel at skeleton bitmap coordinate (i,j) which meets all of the following criteria is identified:

1. the pixel has a connectivity value of one
2. the pixel has from two to six active neighbours
3. at least one of pixels (i,j+1), (i−1,j) and (i,j−1) is inactive
4. at least one of pixels (i−1,j), (i+1,j) and (i,j−1) is inactive.

All of the pixels identified in this way are then set to inactive, and the first step is complete.

If any pixels were set to inactive in the first step then the skeleton bitmap as altered in the first step is used in the second step. In the second step, each active pixel which meets both of the following criteria is identified:

1. at least one of pixels (i−1,j), (i,j+1) and (i+1,j) is inactive
2. at least one of pixels (i,j+1), (i+1,j) and (i,j−1) is inactive.

All of the pixels identified in this way are then set to inactive, and the second step is complete.

If any pixels were set to inactive in the second step then the process iterates, going back to the first step. The process iterates until no pixel is set to inactive in either the first or second step. If a preset maximum number of iterations is reached then the bitmap subject 106 is deemed inappropriate for the entire CAN object creation process, and the process is abandoned. Typically, this may be because parts or all of the subject are too thick, and a more appropriate process should be used to generate fill stitch CAN objects.

A final stage in the generation of the skeleton bitmap 112 is simplification by removing points which are redundant or misleading to later processes, thus paring the skeleton down to only useful pixels identifiable as parts of nodes or paths. In particular, stepping redundancies are removed in the same manner as discussed above in respect of the outline bitmap 110.

Finding Nodes and Paths

A node scan is carried out by comparing each active pixel of the skeleton bitmap 112 and the eight adjacent pixels, as a block, with each of a number of known node matrices. If a match is found then the pixel's position, nodal value (number of paths leading off the node) and nodal shape (index of the matching node matrix) are noted in a node list.

The node scan permits adjacent nodes to be added to the node list, but it is often the case that one of two adjacent nodes is redundant. The node list is therefore scanned to find and remove any such redundant nodes.

Each node matrix is a square block of nine pixels with the center pixel set to active and one, three or more of the boundary pixels set to active, to depict a node pattern. The set of node matrices includes all possible three and four path node patterns, as well as lonely node patterns. Matrices for nodes having five or more paths may be used, if required. The necessity for such matrices will depend principally on the details of the skeletonization and node redundancy routines used.

Each node defines an end point of one, three or more skeleton paths. The pixels of each path are stored as a list of pixels in a path array. Pointers to the pixel list for a path are stored in association with each node connected to that path.

The paths and nodes that do not accurately reflect the ideal skeleton of the subject are now removed by means of appropriate filtering functions. The filtering functions that are applied may depend on the type of stitch or fill pattern that is intended for the subject. If an area filling stitch such as satin stitch is to be used then these functions may, in particular, include despiking, debowing and deforking functions. If a running stitch is to be used then the subject is likely to be comprised of narrow lines, and less filtering will be required.

Figure 6:
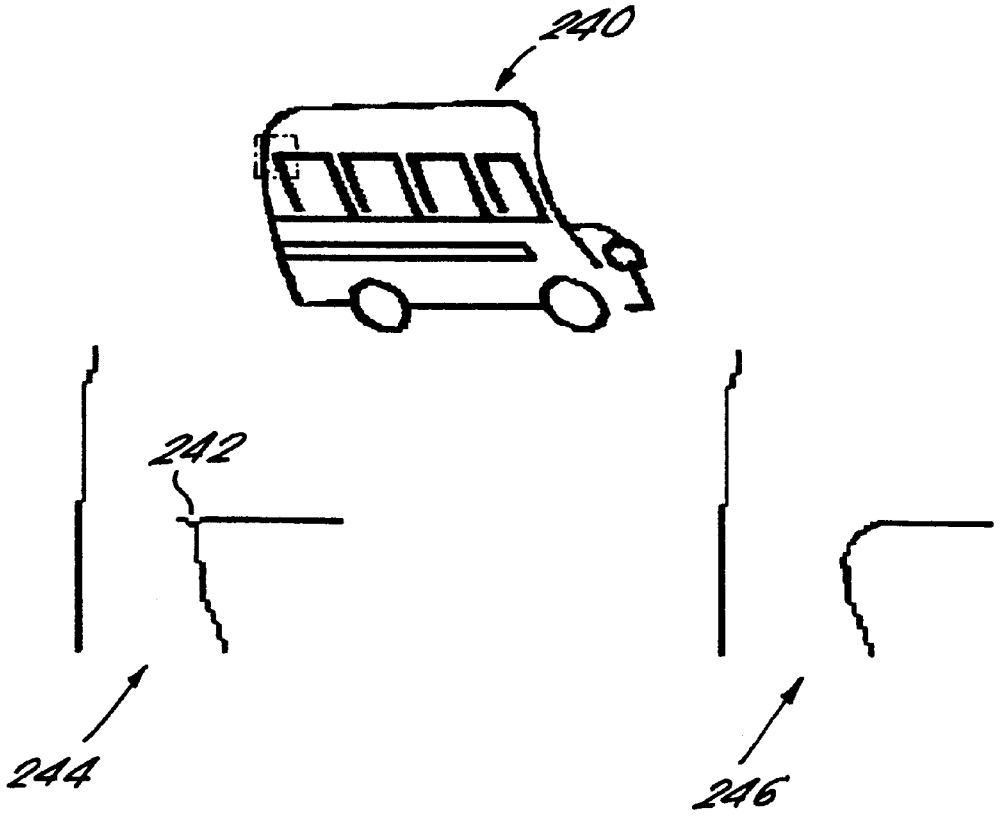
FIG. 6 illustrates the occurrence of a spike artifact and its removal from the path/node structure of a skeleton.

Spiking is an artifact of the thinning process which creates a path where none existed in the original subject. This tends to happen where a part of the subject geometry exhibits a sharp corner, in which case the thinning algorithm tends to create a peak on the outer curve of the corner. An example of a spiking artifact is shown in FIG. 6. A subject suitable for stitching in a satin stitch is shown at 240. A section of a skeleton of this subject showing a spike artifact 242 is shown at 244. The same skeleton after the spike artifact has been removed by appropriate filtering is shown at 246.

A path can be identified as a spike artifact using a selection of criteria, including:

1. the path ends in a lonely node;
2. the path is relatively short and extends from a node with a nodal value of three;
3. the path extends from the node roughly half way between two other paths extending from the node;
4. the breadth of the part of the original subject bitmap that was thinned to create the path, taken perpendicular to the path, decreases in the direction of the lonely node, to form a sharp corner in the outline.

Figure 7:
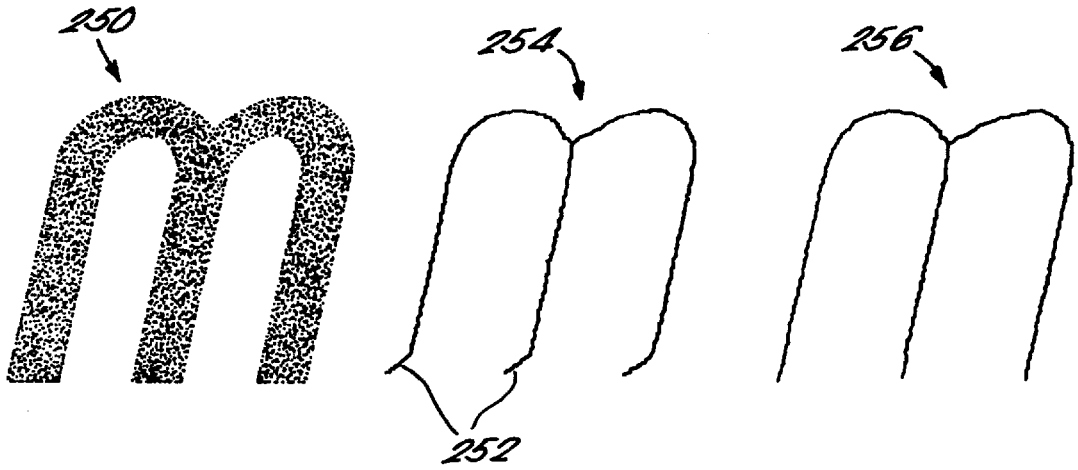
FIG. 7 illustrates the occurrence of bowing artifacts and their removal from the path/node structure of a skeleton.

Bowing is an artifact occurring in paths adjacent to lonely nodes, and is characterised by a veering of the path towards the corner of a rectangular end section of the original subject. An example of a bowing artifact is shown in FIG. 7. A subject suitable for stitching in a satin stitch is shown at 250. A skeleton of this subject showing a number of bowing artifacts 252 is shown at 254. The same skeleton after the bowing artifacts have been removed by appropriate filtering is shown at 256.

A bowing artifact in a path can be identified using a number of criteria, including:

1. one and only one end of the path is a lonely node;
2. the start point of the bowing artifact is marked by a sudden change in angle in a path which is otherwise relatively smooth, and the path after the sudden angle change is fairly straight and converges with the outline at a sharp angle in the outline;
3. the two distances from the outline to the path, when taken perpendicularly to the path direction immediately before the bowing artifact, become increasingly different as the lonely node is approached.

Forking is another artifact of the thinning process. Fork artifacts are processed by deleting the two paths that constitute the fork, and their common node, and extending the prefork path to a new lonely node adjacent to the subject outline.

Figure 8:
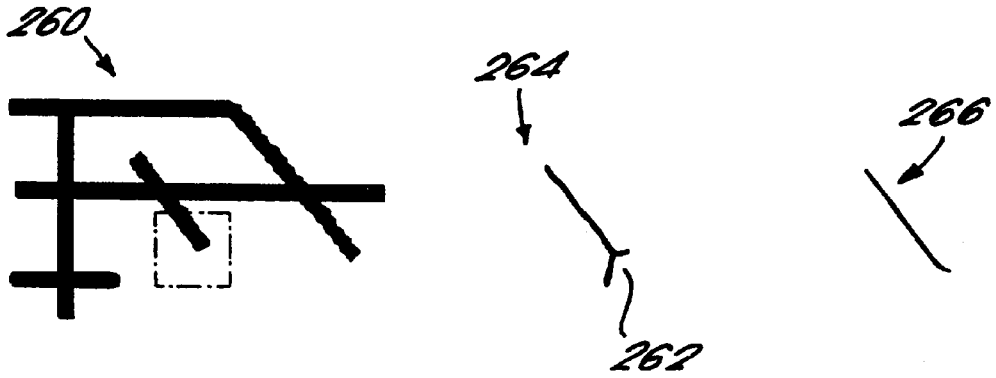
FIG. 8 illustrates the occurrence of a forking artifact and its removal from the path/node structure of a skeleton.

An example of a forking artifact is shown in FIG. 8. A subject suitable for stitching in a satin stitch is shown at 260. A part of a skeleton of this subject showing a forking artifact 262 is shown at 264. The same skeleton part after the forking artifact has been removed by appropriate filtering is shown at 266.

A forking artifact can be identified using a number of criteria, including:

1. Each prong of the fork ends in a lonely node, and the forks are joined at a node with a nodal value of three;
2. Any line drawn between the two prongs is wholly contained within the outline of the subject.

Irrespective of the type of stitch which may be used to embroider a subject, certain paths are extended to more fully reflect the shape of the subject. In particular, the thinning process tends to reduce the length of paths which end in lonely nodes. An extension to the outline of the subject is therefore made to certain paths which end in a lonely node.

Paths which are too small to have any morphological significance and which end at lonely nodes will make the object-based description of the subject and the stitching process more complex to the detriment of the final product. Such paths are therefore deleted.

Identifying Object Control Points

In order to generate a satin or fill stitch object for a segment of a subject which is defined by a path and the adjacent outline, it is necessary to determine object control points along the outline which define corners or end points of the object adjacent to each node. The outline of the object can then be defined by the subject outlines between these control points and by lines joining the two control points adjacent to each junction node either to each other or to the junction node itself. If the two control points adjacent to a junction node are joined directly to each other then an extra CAN object needs to be generated to represent the triangular area defined by the control points and the junction node.

Where a path ends in a lonely node both control points for that node can be combined into a single control point where the path, extended as necessary from the lonely node, touches the outline.

Figure 9:
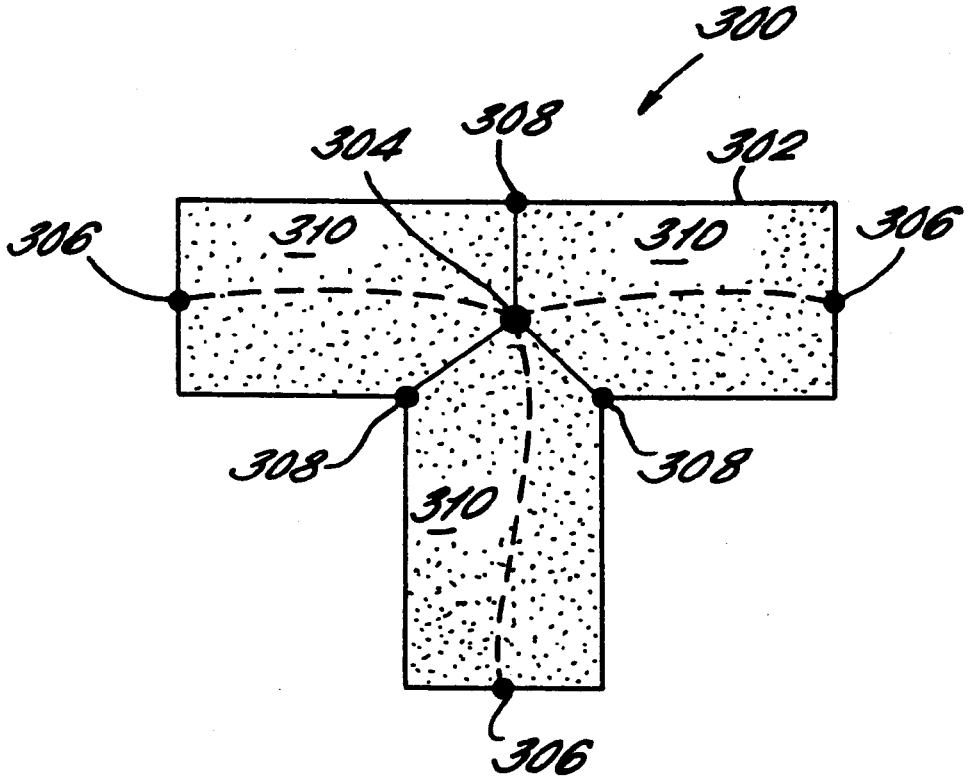
FIG. 9 illustrates the segmentation of a subject bitmap into stitchable objects by using control points.

The positioning of control points is illustrated in FIG. 9 which shows an outline 302, a junction node 304 and lonely nodes 306 derived from an original subject 300. Control points 308 are derived for the outline adjacent to the junction node 304. Further control points are collocated with the lonely nodes 306. The paths joining the nodes are shown as dashed lines.

The three CAN objects 310 which need to be generated in order to stitch out the object are stippled. The outlines for these objects are defined by the subject outline 302 between the control points 308 and the control points at the lonely nodes 306, and lines joining the control points 308 and the junction node 304.

A number of factors may be taken into account in determining the best location for control points 308 adjacent to a junction node 304, including:

1. intersections of the outline with lines bisecting paths at the junction node;
2. sharp changes in outline direction close to the junction node;
3. the points on the outline that are nearest to the junction node.

Production of CAN Objects

Embroidery CAN objects to represent the subject are generated using a recursive process which traverses the paths and nodes of the skeleton, generating CAN objects at the same time. To generate satin or other fill stitch objects to embroider the subject, while using an unbroken stitching sequence throughout, a running stitch object is generated to follow a path on the first traversal of that path, and the satin or fill stitch is laid on the second traversal of the path, thus covering over the first running stitch object. Further traversals of the path are avoided. The same algorithm is used to generate objects to embroider a subject in running stitch only, with running stitch objects being generated on both the first and second traversals.

Starting from an arbitrary node the process for generating objects of a chosen stitch type can be defined by the following steps:

A. choose an untraversed path leading from the present node;

B. traverse the chosen path to a new node, and generate a running stitch object defined by points along the chosen path;

C. if all paths leading from the present node have been traversed at least once, then goto D, otherwise goto A.

D. traverse the most recently traversed path and generate a stitch object of the chosen stitch type and goto C.

Objects for satin or other area filling stitch types are generated using the control points and outlines between those control points as discussed above. Triangular infill objects adjacent to junction nodes are also generated, in sequence with the other objects according to the path traversal sequence, if required.

The objects created are combined, along with other objects as required, into an object-based description file. This may be subsequently converted into a vector-based stitch file for controlling an embroidery machine to stitch out the original embroidery subject.

Figure 10:
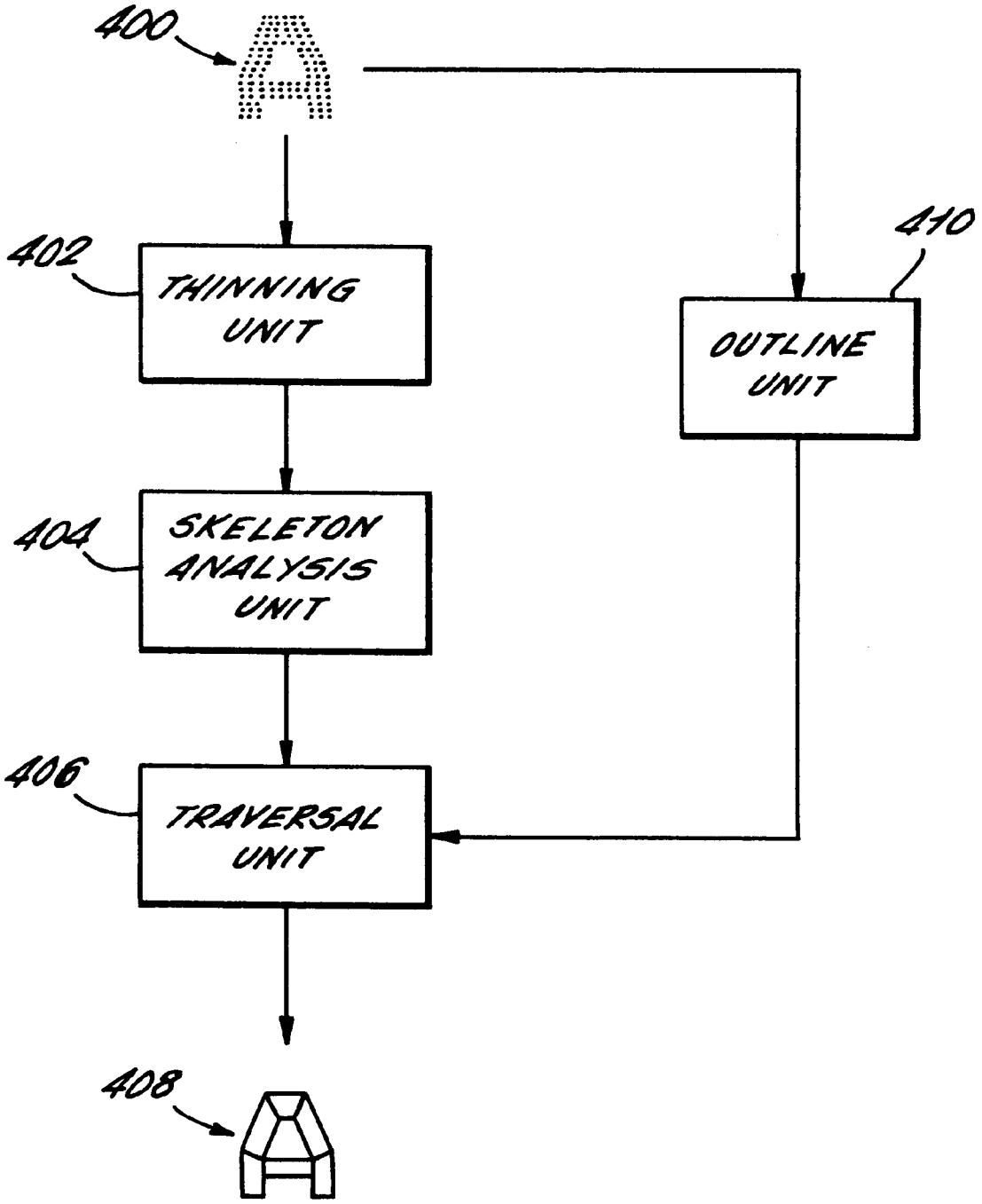
FIG. 10 illustrates data processing units for carrying out the invention.

FIG. 10 illustrates process units, typically implemented using a suitably programmed computer, for carrying out the method described above. A subject bitmap 400 held in a computer readable file is passed to a thinning unit 402 which analyses the subject bitmap to produce a skeleton of the subject. The skeleton is passed to a skeleton analysis unit 404 which analyses the skeleton to identify a plurality of nodes interlinked by a plurality of paths. The nodes and paths are passed to a traversal unit 406 which traverses the paths and nodes as already discussed, and, during the traversal, generates a series of objects describing the subject for the object based description 408. An outline unit 410 analyses the subject bitmap to identify an outline of the subject which is used by the traversal unit to define at least a part of the boundary of at least some of the generated objects.

What is claimed is:

1. A method of operating a computer to produce an object-based description of an embroidery pattern subject, from a subject bitmap describing the subject, the method comprising the steps of:

analyzing the subject bitmap to identify a skeleton of the subject;

analyzing the skeleton to identify a plurality of nodes interlinked by a plurality of paths;

traversing the skeleton by following the paths and nodes; and during the traversal, generating a series of objects describing the subject for the object-based description.

2. The method of claim 1 wherein the step of traversal includes the steps of:

starting at a selected node; and moving between nodes by following the paths interlinking the nodes in such a manner that each path is traversed a first time and a second time.

3. The method of claim 2 wherein the step of generating includes the steps of:

when a path is traversed for the first time, generating for the path an object having a first stitch type; and when a path is traversed for the second time, generating for the path an object having a second stitch type.

4. The method of claim 3 wherein both the first stitch type and the second stitch type are linear stitch types.

5. The method of claim 3 wherein the first stitch type is a linear stitch type and the second stitch type is an area filling stitch type.

6. The method of claim 5 further comprising the steps of:

analyzing the subject bitmap to identify an outline of the subject, and using the outline to define at least a part of the boundary of at least some of the generated objects of the second stitch type.

7. The method of claim 1 wherein the step of analyzing the subject bitmap to identify a skeleton of the subject comprises the step of applying a thinning algorithm to a copy of the subject bitmap to generate the skeleton.

8. The method of claim 7 wherein the thinning algorithm is a Xhang-Suen type stripping algorithm.

9. The method of claim 1 further comprising the steps of:

receiving a preliminary bitmap depicting the subject;

expanding the preliminary bitmap by increasing the number of pixels depicting the subject; and using the expanded preliminary bitmap to provide the subject bitmap.

10. Computer apparatus programmed to produce an object-based description of an embroidery pattern subject, from a subject bitmap describing the subject, by processing the subject bitmap according to the method of claim 1.

11. A computer readable data carrier containing program instructions for controlling a computer to perform the method of claim 1.

12. A computer readable data carrier containing an object-based description of an embroidery pattern subject, which description has been produced by the method of claim 1.

13. A computer readable data carrier containing a vector-based stitch file created from an object-based description of an embroidery pattern subject produced by the method of claim 1.

14. A computer controlled embroidery machine controlled by a vector-based stitch file created from an object-based design description of an embroidery pattern subject produced by the method of claim 1.

15. An embroidery data processor for producing an object-based description of an embroidery pattern subject, from a subject bitmap describing the subject, comprising:

a thinning unit for analyzing the subject bitmap to produce a skeleton of the subject;

a skeleton analysis unit for analyzing the skeleton to identify a plurality of nodes interlinked by a plurality of paths; and a traversal unit for traversing the skeleton by following the paths and nodes and, during the traversal, generating a series of objects describing the subject for the object-based description.

16. The data processor of claim 15 wherein the traversal unit is adapted to start at a selected node and to move between nodes by following the paths interlinking the nodes in such a manner that each path is traversed a first time and a second time.

17. The data processor of claim 16 wherein the traversal unit is adapted to generate for a path an object having a first stitch type when the path is traversed for the first time, and to generate for the path an object having a second stitch type when the path is traversed for the second time.

18. The data processor of claim 17 wherein both the first stitch type and the second stitch type are linear stitch types.

19. The data processor of claim 17 wherein the first stitch type is a linear stitch type and the second stitch type is an area filling stitch type.

20. The data processor of claim 19 further comprising an outline unit for analyzing the subject bitmap to identify an outline of the subject, the traversal unit being adapted to use the outline to define at least a part of the boundary of at least some of the generated objects of the second stitch type.

21. The data processor of claim 15 wherein the thinning unit is adapted to apply a thinning algorithm to a copy of the subject bitmap to generate the skeleton.

22. The data processor of claim 21 wherein the thinning algorithm is a Xhang-Suen type stripping algorithm.

* * * * *